United States Patent [19]

Shields

[11] Patent Number: 4,709,473

[45] Date of Patent: Dec. 1, 1987

[54] DISAPPEARING SHELF ASSEMBLY FOR USE IN AN ELECTRICAL CONNECTOR APPLYING MACHINE

[76] Inventor: Charles E. Shields, 655 Woodland, Crystal Lake, Ill. 60014

[21] Appl. No.: 886,375

[22] Filed: Jul. 17, 1986

[51] Int. Cl.[4] ..... H01R 43/04

[52] U.S. Cl. ..... 29/749; 29/753; 29/759

[58] Field of Search ..... 29/749, 753, 759, 760, 29/566.3, 861

[56] References Cited

U.S. PATENT DOCUMENTS 4,486,949 12/1984 Allen ..... 29/749 X 4,594,776 6/1986 Anderson ..... 29/749

*Primary Examiner*—Carl E. Hall

*Attorney, Agent, or Firm*—Hill, Van Santen, Steadman & Simpson

[57] ABSTRACT

An improved machine for applying electrical connectors to electrically conductive cable, such as multi-conductor flat cable. The machine includes a pair of opposed tool members, each of which include a shelf-like recess for receiving a connector portion. The cable is positioned between the tool members which are advanced toward each other for staking the connector body portion to the cable and receiving the connector cap to the connector body, and thus securing the connector to the cable.

In each tool member the shelf-like recess is formed from a shelf which is slidably mounted to the tool member and biased to an outward position. When the shelf engages the cable and other tool member, it retracts and the tool member urges the connector onto the cable. Upon retraction of the tool member, the shelf is biased to its extended position.

8 Claims, 6 Drawing Figures

DISAPPEARING SHELF ASSEMBLY FOR USE IN AN ELECTRICAL CONNECTOR APPLYING MACHINE

BACKGROUND OF THE INVENTION

This invention relates to the art of applying electrical connectors to electrical conductors, and more particularly, to improvements in a machine which applies electrical connectors to multi-conductor flat cable of the type used in electronics, particularly in the computer field.

Multi-conductor flat cable is used extensively in the electronic industry and particularly in the computer field to interconnect various system elements and components. The actual connections are made through electrical connectors secured to or terminated on the cable, which connectors usually electrically contact each conductor. Depending upon the specific application a cable can have two or more connectors secured thereto.

Each connector has two portions or halves, a cap and a body, and the conductor cable is sandwiched between the halves. Sometimes the connector is said to be "staked" to the cable. The body half includes insulation piercing tine-like contacts for engaging and electrically contacting each conductor. The cap secures the connector body to the cable and in effect sandwiches the cable between the cap and body.

Machines have been developed to apply these connectors to the cable. One such machine is disclosed in U.S. Pat. No. 4,580,340 for precisely positioning the connector on the cable and securing the connector to the cable. In that patent a pair of connector feed assemblies or magazines each delivers a connector portion to one of a pair of opposed ram-type feed devices, each of which includes tooling or a head having an interchangeable insert which defines a shelf-like recess for receiving a connector portion. The cable is positioned between the feed devices and tooling, such that when the tooling is advanced the connector body is staked to the cable, the connector cap is secured to the connector body and the connector thus secured to the cable.

Each connector section coming from a feed device falls into the recess in the tooling or head and the section is then staked to the cable. The dimensions of the insert are about the same as the dimensions of the connector portions which requires precise delivery of the connector half to the insert. Furthermore, since the recess is formed in the tooling or head, the movement of the tooling must be very accurately controlled during "staking" so as to permit the connectors to precisely engage the cable on the extension stroke of the ram. If the stroke is too short, then termination or staking is not precise or secure, and if the stroke is too long, the rams, tooling or connection portions may collide damaging the connector or making the connection defective.

It is therefore an object of this invention to provide a connector terminating machine which is constructed to reliably and accurately receive connector portions delivered from feed devices and stake the connectors to a multi-conductor cable.

It is another object of this invention to provide connector receiving tooling and insert which is self correcting as to the length of the stroke of the connector staking ram.

These and other objects of this invention shall become apparent from the following description and appended claims.

SUMMARY OF THE INVENTION

There is disclosed herein a "sliding insert or disappearing ledge" structure which defines a comparatively large shelf for receiving connector portions so as to assure more accurate receipt and alignment of the connector than with prior inserts. Furthermore, the insert is slidably mounted to the connector staking tooling which is carried on one of the rams. The tooling and insert are constructed so that when the connectors engage the cable, the inserts retract by sliding into the tooling as the tooling continues to urge the connector portions onto the cable and stakes the connector to the cable. Thus the insert accurately receives and carries the connector portions and also adjusts for differences in the stroke of the ram.

DESCRIPTION OF THE PREFERRED EMBODIMENTS

Figure 1:
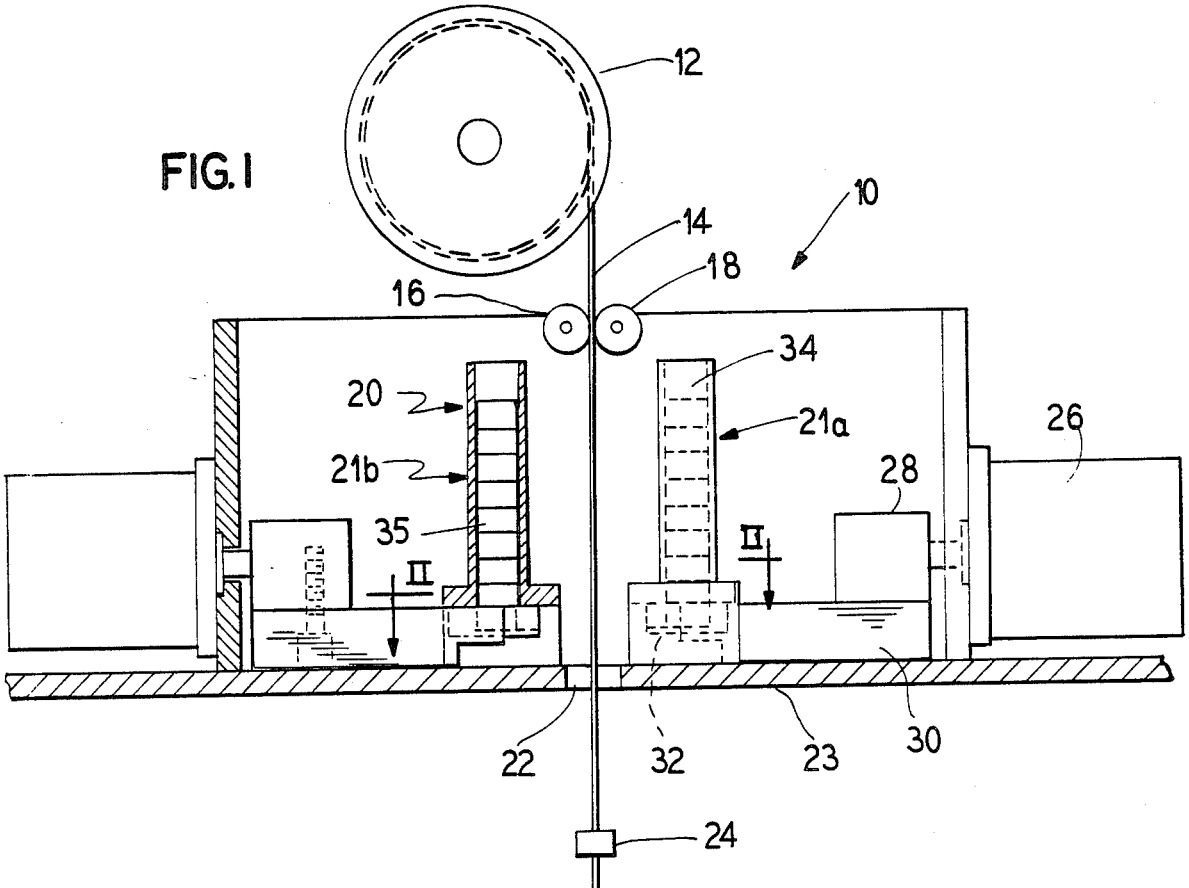
FIG. 1 is a side elevational view of the connector staking machine of this invention.

Referring now to the drawings, particularly FIG. 1, a connector applying machine 10 is shown.

The machine includes a cable supply reel 12, about which flat multi-conductor cable 14 is wound and from which cable 14 is drawn by feed rollers 16 and 18 and fed past the connector applying stations 20 generally, through an aperture 22 in the machine base 23. A staked connector 24 is shown on the cable 14, which is positioned for collection when the cable 14 has been finished and cut to length.

The connector applying stations 20 include a pair of substantially identical and opposed sections **21*a* and 21*b*. Each section includes a ram, such as 26, connected to the machine and through a block 28 to tooling 30 which includes a disappearing shelf or ledge assembly 32. A connector section feed device or magazine, such as 34 or 35, is positioned above the tooling and in a position to deliver a connector portion to the shelf or ledge assembly 32. The tooling is advanced from the connector receiving position to the staking position and retracted therefrom by the ram 26. The machine base 23 supports the tooling and side guides 38 and 40** guide the tooling as it is moved between the advanced and retracted positions.

Figure 2:
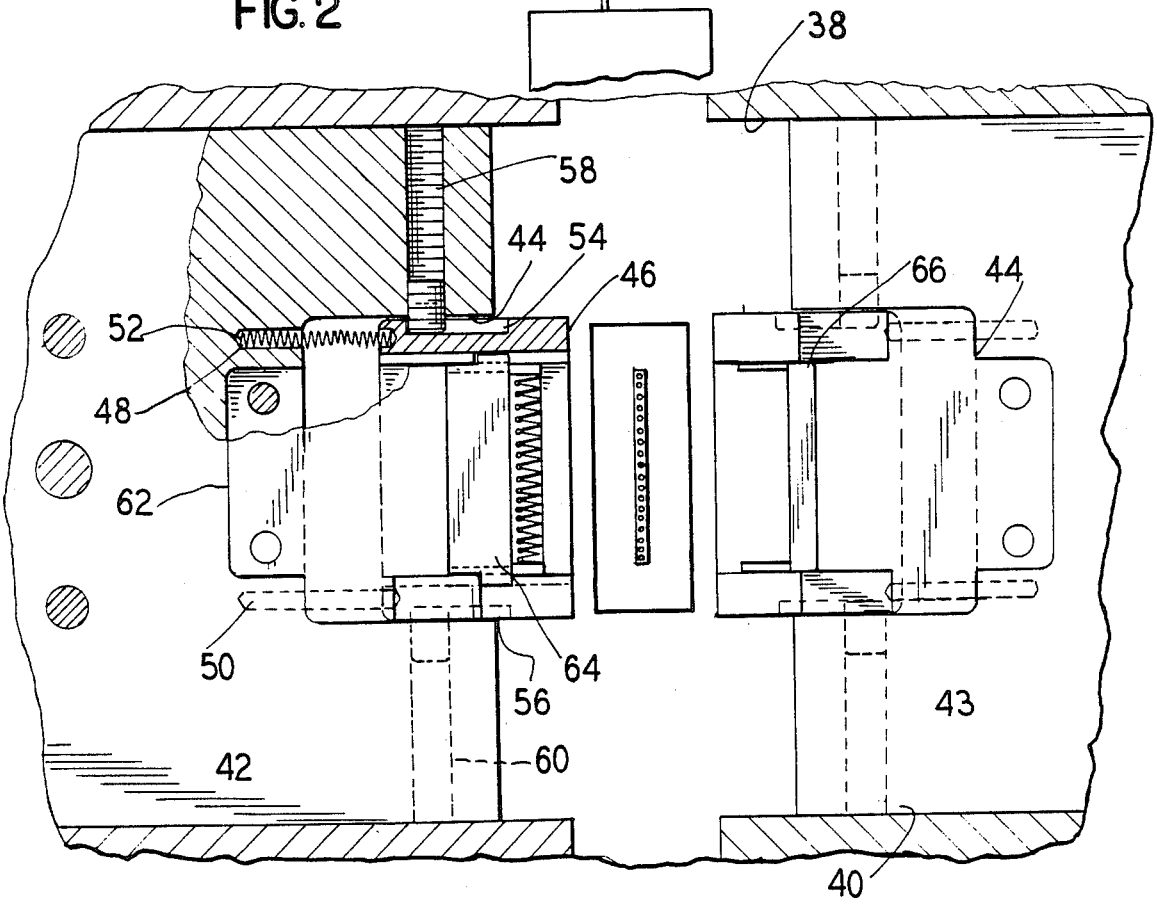
FIG. 2 is a plan view taken along line II—II of FIG. 1 showing connector halves received on the tooling and the extended inserts.

Referring now to FIG. 2, the tooling 30 includes a body 42 or 43 having a shelf or ledge insert receiving slot construction 44 at the center of the leading edge. The insert includes a shelf member 46 that is slidably mounted in the slot 44. In the extended position, the forward end of the shelf is forward of the tooling, and in the retracted position, the forward end is aligned with the tooling edge. The tooling body has a pair of drilled biasing spring-receiving holes 48 and 50, each of which receives a biasing spring such as 52 for biasing the shelf forwardly or outwardly from the base.

Movement limiting slots 54 and 56 are cut into the side surfaces of each shelf so as to limit the inward and outward or retracted and extended movement of the shelf. Adjustment screws 58 and 60 extend through the body 42, and the screw ends are positioned in the slots so as to limit the inward and outward movement. A cover 62 is fitted over the shelf so as to hold all of the components of the shelf, springs, etc., together.

As shown in FIG. 2, a connector body 64 is received on the left-hand shelf for staking to the cable, and the connector cap 66 is received on the right-hand shelf to be secured to the cable 14 and connector body. It is seen that the shelves provide a rather large surface for receiving the connector section.

Figure 3:
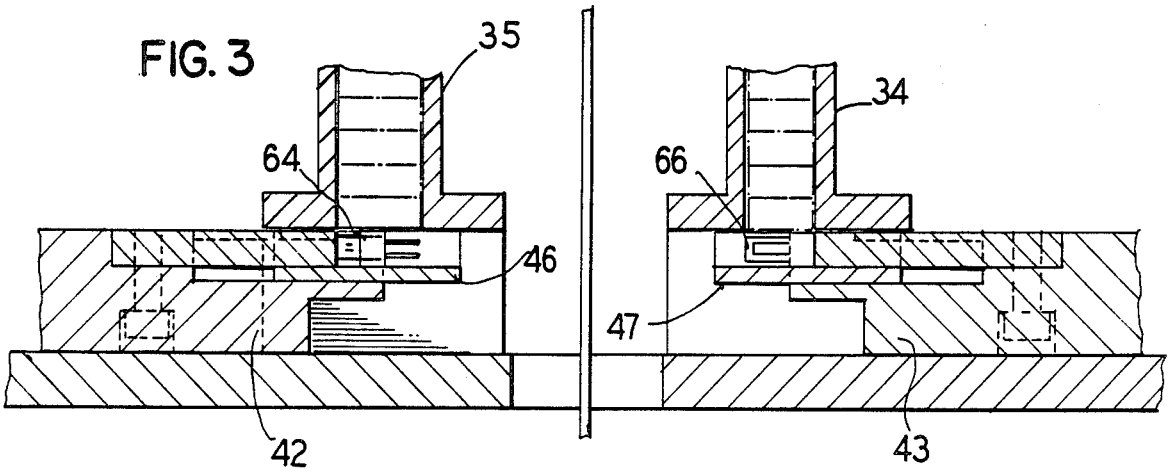
FIG. 3 is an enlarged elevational view showing the tooling and inserts receiving a connector section and prepared for staking.
Figure 4:
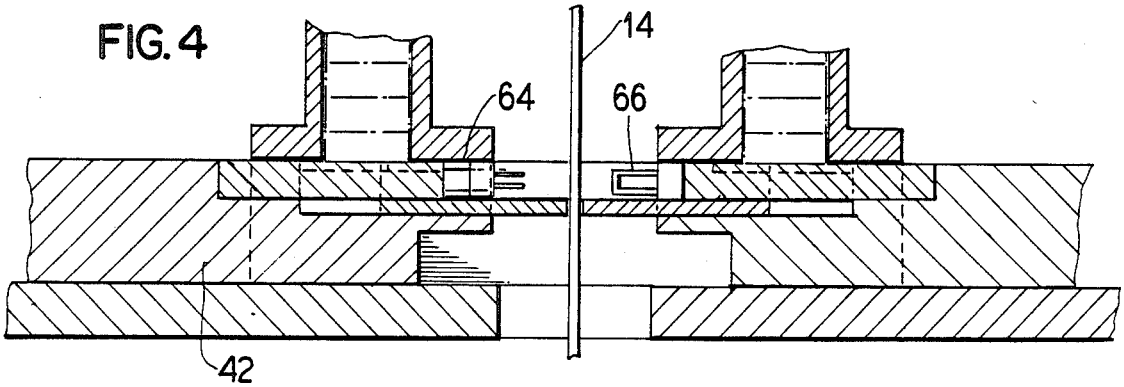
FIG. 4 is an elevational view showing the tooling, insert and connector section moved toward the staking position.

Referring now to FIG. 3, the tooling is shown retracted, and the shelves 46 and 47 are shown extended and having received a connector section from a magazine such as 34 or 35.

In the next stage of operation the bodies 42 and 43 are advanced, the shelves are still extended, the connector halves are still on the shelves, and the shelves engage the cable 14 with the shelf in the extended position. No connection with the cable, such as staking, has yet been made.

Figure 5:
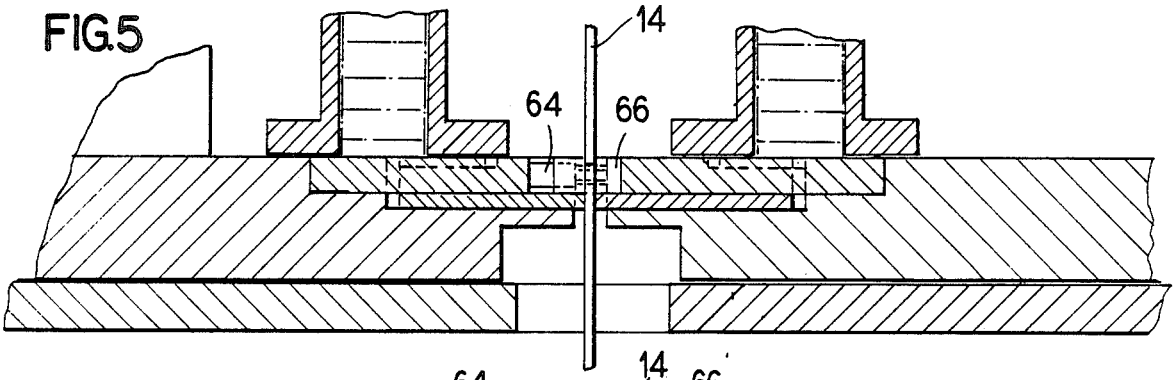
FIG. 5 is an elevational view showing the connector section staked to the cable and the insert in a retracted position.

As shown in FIG. 5, the rams continue to advance the bodies 42 and 43 toward engagement with the cable 14, and upon engagement, the shelves 46 and 47 retract or slide into the tooling, against the spring bias. The tooling body then urges the connector body into staking relation with the cable and the connector halves into engagement with each other so as to make the desired electrical connections.

Figure 6:
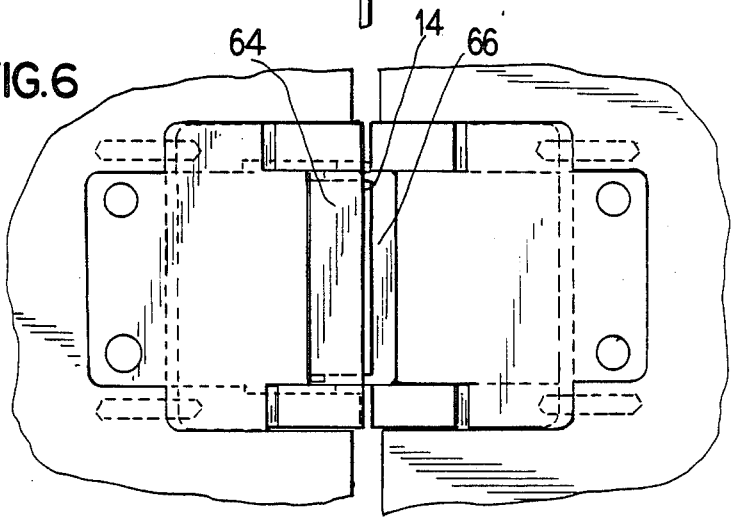
FIG. 6 is a top view showing the staking operation and the retraction of the inserts.

FIG. 6 is a top view showing the retracted position of the shelf as retracted into the tooling.

In the next set up, the rams retract the tooling and the shelves extend under the influence of the biasing springs. The connector halves release from the shelves and are securely fastened to the cable.

The tooling is retracted to a position where each shelf is again aligned with a connector magazine and receives another connector section. The cable is then fed to the next cable staking portion and the staking cycle is repeated.

Another feature of this invention relates to the interchanging of the shelf, such as 46 and 47. The specific shelf as shown could be replaced with other shelves having a different size recess for receiving connector portions of different sizes, types, or brands without adjustment to other mechanism. This would be done by removing the cover, fitting a new shelf in place and then replacing the cover in position without changing or affecting any other part of the machine or mechanism.

It will be appreciated that this system permits the connectors to be readily received by the insert shelf and to be readily staked to the cable.

Although the invention has been described with respect to preferred embodiments, it is not to be so limited as changes and modifications can be made to the embodiments of this invention without departing from the spirit and scope thereof.

I claim as my invention:

1. A machine for applying an electrical connector to a cable which includes, means for supplying a cable to which a connector is to be applied, means for supplying connector sections, means for receiving connector sections from the supply means and for applying connector sections to a cable, which includes tooling means for receiving a connector section and means for advancing said tooling means toward said cable and retracting said tooling means therefrom; wherein the improvement comprises said tooling means including shelf-like means carried thereon and constructed for movement relative to said tooling means between an extended connector-section receiving position and a retracted connector-section staking position, and there being provided biasing means associated with the tooling means and shelf-like means for urging said shelf-like means toward said extended position.

2. A machine as in claim 1, wherein said tooling means includes a forward edge and said shelf in the extended position is forward of said tooling forward edge and in the retracted position is substantially aligned with said forward edge.

3. A machine as in claim 2, wherein said shelf-like means defines a recess for receiving a connector section which is larger than the connector section for enhancing receipt of the connector section by said shelf-like means.

4. A machine as in claim 1, wherein said tooling means further includes ram means for urging said tooling means toward said cable and retracting said tooling means from the extended position.

5. A machine as in claim 1, wherein said tooling means includes a pair of tool members, each of said tool members carrying a retractable shelf, each of said tool members being extendable toward the cable and the other tooling member and adapted to retract upon engagement with the cable and the other tooling member, and said tool members constructed to urge said connector sections against said cable and into engagement therewith.

6. A machine as in claim 1, wherein said tooling means and said shelf-like means includes means for limiting movement of the shelf means in the extended and retracted directions.

7. A machine as in claim 1, wherein said shelf-like means is removably mounted to the tooling means and there is further provided replacement shelf-like means for accommodating different size connectors, constructed to replace and be interchangeable with said first shelf-like means.

8. A machine for applying an electrical connector to a substantially flat multi-conductor cable, which connector includes a body section and cap section, said machine including a pair of connector feed devices for delivering a connector section to a feed station, means for positioning a cable between the connector feed devices, a pair of opposed tool members, each including shelf-like recess means for receiving one of the connector sections and constructed for extension toward said cable means for securing said connector to said cable, wherein the improvement comprises each of said tool members including means slidably mounted thereto and biased to an extended position toward said cable and other tool member and retractable therefrom upon engagement with said cable and other tool member, so that each tool member acts to urge a connector section into engagement with said cable, and said shelf means defining an enlarged area for accurately receiving and positioning a connector section.

* * * * *